US005202205A

United States Patent [19]

Malhota

[11] Patent Number: 5,202,205

[45] **Date of Patent: * Apr. 13, 1993**

[54] TRANSPARENCIES COMPRISING METAL HALIDE OR UREA ANTISTATIC LAYER

[75] Inventor: Shadi L. Malhota, Mississauga, Canada

[73] Assignee: Xerox Corporation, Stamford, Conn.

[ * ] Notice: The portion of the term of this patent subsequent to Mar. 5, 2008 has been disclaimed.

[21] Appl. No.: 544,577

[22] Filed: Jun. 27, 1990

[51] Int. Cl.[5] ..... G03C 3/00

[52] U.S. Cl. ..... 430/17; 430/11; 430/18; 428/330; 428/352; 428/331

[58] Field of Search ..... 430/17, 18, 11; 428/330, 201, 214, 202, 352, 330, 331

[56] References Cited

U.S. PATENT DOCUMENTS

| | | | |
|---|---|---|---|
| 3,861,942 | 1/1975 | Guestaux | 117/34 |
| 3,993,549 | 11/1976 | Bush et al. | 204/159.22 |
| 4,013,696 | 3/1977 | Babbitt et al. | 428/412 |
| 4,370,379 | 1/1983 | Kato et al. | 428/341 |
| 4,480,003 | 10/1984 | Edwards et al. | 428/329 |
| 4,489,122 | 12/1984 | Kammin et al. | 428/212 |
| 4,526,847 | 7/1985 | Walker et al. | 430/18 |
| 4,542,095 | 9/1985 | Steklenski et al. | 430/527 |
| 4,547,405 | 10/1985 | Bedell et al. | 427/256 |
| 4,592,954 | 6/1986 | Malhotra | 428/335 |
| 4,637,974 | 1/1987 | Kubit | 430/126 |
| 4,711,816 | 12/1987 | Wittnebel | 428/412 |
| 4,997,697 | 3/1991 | Malhotra | 428/195 |

*Primary Examiner*—Marion E. McCamish
*Assistant Examiner*—Rosemary Ashton
*Attorney, Agent, or Firm*—E. O. Palazzo

[57] ABSTRACT

A transparent substrate material for receiving or containing an image comprised of a supporting substrate, an ink toner receiving coating composition on both sides of the substrate and comprised of an adhesive layer and an antistatic layer contained on two surfaces of the adhesive layer, which antistatic layer is comprised of mixtures or complexes of metal halides, or urea compounds both with polymers containing oxyalkylene segments.

43 Claims, No Drawings

TRANSPARENCIES COMPRISING METAL HALIDE OR UREA ANTISTATIC LAYER

BACKGROUND OF THE INVENTION

This invention relates generally to transparencies which, for example, are suitable for various printing processes such as ink jet, dot matrix, electrographic and xerographic imaging systems, including color systems. More specifically, the present invention is directed to transparencies with certain coatings thereover, which transparencies, that is for example transparent substrate materials for receiving or containing a toner image, possess compatibility with toner and ink compositions, and permit improved toner and ink flow in the imaged areas of the transparency thereby enabling images of high quality, that is for example images with optical densities of greater than 1.0 in several embodiments, excellent tone fix, about 100 percent in some instances, and no or minimized background deposits to be permanently formed thereon. In one embodiment of the present invention, there are provided electrophotographic, especially xerographic, ink jet, dot matrix printers and the like; transparencies, that is for example a transparency useful in xerographic apparatuses such as the Xerox Corporation 1025 TM, the Xerox 1075 TM, the Xerox Ink Jet 4020 TM, and in dot matrix printers, such as the Roland PR-1012 TM and the like comprised of a supporting substrate; and an ink or toner receiving coating composition on both sides of the substrate and comprised of an adhesive layer polymer such as chlorinated poly(isoprene), chlorinated poly(propylene), blends of phosphate esters with poly(styrene), and the like, and an antistatic layer on one, or both sides of the adhesive layer, which antistatic layer is comprised of complexes of metal halides such as potassium iodide, urea compounds such as urea phosphate, and the like, with polymers containing oxyalkylene units such as poly(ethylene oxide), poly(propylene oxide), ethylene oxide/propylene oxide block copolymers, ethoxylated amines and the like, and an optional resin binder polymer such as poly(2-hydroxyethylmethacrylate), poly(2-hydroxypropylmethacrylate), hydroxypropylmethyl cellulose and the like. The coating composition may have dispersed therein colloidal silica particles, and other similar components for the primary purpose of traction during the feeding process. Also, the present invention is directed to imaged transparencies comprised of a supporting substrate with coating layers as illustrated herein.

Many different types of transparencies are known, reference for example U.S. Pat. No. 3,535,112, which illustrates transparencies comprised of a supporting substrate, and polyamide overcoatings. Additionally, there are disclosed in U.S. Pat. No. 3,539,340 transparencies comprised of a supporting substrate and coating thereover of vinylchloride copolymers. Also known are transparencies with overcoating of styrene acrylate or methacrylate ester copolymers, reference U.S. Pat. No. 4,071,362; transparencies with blends of acrylic polymers and vinyl chloride/vinylacetate polymers as illustrated in U.S. Pat. No. 4,085,245; and transparencies with coatings of hydrophilic colloids as recited in U.S. Pat. No. 4,259,422. Furthermore, there are illustrated in U.S. Pat. Nos. 4,489,122 transparencies with elastomeric polymers overcoated with poly(vinylacetate), or terpolymers of methyl methacrylate, ethyl acrylate, and isobutylacrylate; and (2) 4,526,847 transparencies comprised of overcoating of nitrocellulose and a plasticizer. The disclosures of each of the aforementioned patents are totally incorporated herein by reference. The aforementioned coatings primarily contain amorphous polymers which usually do not undergo the desired softening during fusing of, for example, the electrographic, especially xerographic, image which is achieved in a time frame of from about 25 to about 50 milliseconds at a fuser roll temperature of about 175° C. Some of these coating also contain antistatic agents which are primarily quaternary ammonium salts such as alkylbenzyldimethyl compounds, ionic salts such sodium chloride, nonionic surfactants such as alcohol ethoxylates, anionic surfactants such as the sodium salt of sulfated alcohols, cationic surfactants such as amine ethoxylates, electroconductive polymers such as poly(styrene sulfonic acid) sodium salt, and these antistatic agents are not believed to assist in toner fix as they have neither sharp melting points, which are desirable, nor affinity for the hydrophobic xerographic toners. In many instances, when the ink or toner receiving layer contains ionic or nonionic surfactants alone as antistats, their concentrations in the mixture approach as high as 30 percent or even more to be effective for xerographic imaging which requires that the transparency accept charge of between 100 to 400 volts and discharge instantaneously under light. Under the highloading of the antistat, the adhesion of toner to the transparency is usually poor and not acceptable. These and other disadvantages are substantially avoided, or minimized with embodiments of the present invention. More specifically, in one embodiment of the present invention a feature thereof is to minimize the quantities of the oxyalkylene containing antistatic ionic and nonionic polymers, which is achieved by improving their efficiency by complexing them with metal halides such as potassium iodide, sodium iodide, zinc chloride, magnesium chloride, lithium bromide, cadmium chloride and urea compounds, and then using them as antistatic agents. With less of the antistatic component in the transparency, there can be more surface of the adhesive polymer available to the toner resulting in its improved fix to the transparency. Furthermore, certain complexes of metal halides such as potassium iodide with oxyalkylene units containing polymer such as poly(ethylene oxide) are also elastomeric in nature and assist in better toner fix as well as act as antistatic agents even at very low humidity such as 10 percent relative humidity. Conventional antistatic agents such as salts usually fail under these conditions.

In a patentability search report, the following U.S. patents were listed: U.S. Pat. No. 4,711,816 relating to, for example, a transparency sheet material with four layers, see column 2, line 30, and more specifically a prime coat layer with antistatic agents such as polyoxyethylene derivatives, polyglycols, and the like, see column 3; an image receiving layer of, for example, cellulosics, vinyl acetate, acrylonitrile-butadiene-styrene, see columns 3 and 4; and a protective layer of suitable resins such as polyesters; and as background interest U.S. Pat. Nos. 3,861,942; 4,013,696 and 4,480,003.

Also mentioned are U.S. Pat. Nos. 4,547,405 which discloses an ink jet recording sheet comprised of a transparent support with a layer thereover comprising from 5 to about 100 percent by weight of a block copolymer latex of poly(vinyl alcohol) with polyvinyl(benzyl ammonium chloride) and from 0 to 95 percent by weight of a water soluble polymer such as poly(vinyl alcohol), poly(vinyl pyrrolidone) and copolymers thereof, reference the Abstract of the Disclosure, and also note the teachings, for example, in columns 2 and 3 of this patent; 4,055,437 which, according to the Abstract of the Disclosure, discloses a transparent recording medium comprised of a conventional transparency base material coated with hydroxy ethyl cellulose and optionally containing one or more additional polymers compatible therewith, with examples of addition polymers being polyacrylimides, poly(vinyl pyrrolidones), see for example column 2, lines 1 to 21, and note in column 2, beginning at line 60, that as optional additives there may be included in the coating composition for purposes of promoting ease of manufacture, handling and usage, particulate silica or other inorganic pigments to enhance nonblocking and slip properties by acting as a friction reducting agent, see column 2, lines 65 and 66; 4,575,465, which according to the Abstract of the Disclosure, is directed to an ink jet recording sheet comprising a transparent support carrying a layer comprising up to 50 percent by weight of vinyl pyridines/vinyl benzyl quaternary salt copolymer and a hydrophilic polymer selected from gelatin, poly(vinyl alcohol), hydroxyl propyl cellulose, and mixtures thereof, see for example columns 2 and 3, especially column 2, line 60, to column 3, line 12, and also note column 3, line 21, to column 4, line 28; 4,770,934 directed to an ink jet recording medium which, according to the Abstract of the Disclosure, contains at least one ink receptive layer containing synthetic silica of fine particle form as the main pigment, and having a recording surface dried by pressing said surface against a heated mirror surface, and further having an ink receptive layer with an absorption capacity of at least 10 grams/$m^2$, see also the disclosure in columns 3 through 7, and moreover note the working Examples; also see specifically, for example, column 3, line 58, to column 4, line 16; 4,865,914, the disclosure of which is totally incorporated herein by reference, directed to a transparency comprised of a supporting substrate and thereover a blend comprised of poly(ethylene oxide) and carboxymethyl cellulose together with components selected from the group consisting of hydroxypropyl cellulose, and the like, reference the Abstract of the Disclosure, and note specifically the disclosure beginning with column 3, and specifically column 3, line 40; moreover, see specifically column 4, lines 10 to 32.

Also mentioned are U.S. Pat. No. 3,488,189, which discloses fused toner images on an imaging surface wherein the toner particles contain a thermoplastic resin, the imaging surface carries a solid crystalline plasticizer having a lower melting point than the melting range of the thermoplastic resin, and wherein the resulting toner image is heat fused, reference the Abstract of the Disclosure; see also columns 3, 4, and 5, especially at line 71 to column 6; a similar teaching is present in U.S. Pat. Nos. 3,493,412 and 3,619,279, and more specifically the '279 patent mentions in the Abstract of the Disclosure that the external surfaces of the toner receiving member is substantially free of a material plasticizable by a solid crystalline plasticizer, and typically a plasticizer such as ethylene glycol dibenzoate may be available on the surface of the paper; further see column 3, lines 22 to 32, of the '279 patent for the types of receiving surfaces that may be treated; and a selection of patents, namely U.S. Pat. Nos. 3,535,112; 3,539,340; 3,539,341; 3,833,293; 3,854,942; 4,234,644; 4,259,422; 4,419,004; 4,419,005 and 4,480,003 that pertain to the preparation of transparencies by electrostatographic imaging techniques according to the aforementioned report.

Also known are transparency sheet materials for use in a plain paper electrostatic copiers comprising (a) a flexible, transparent, heat resistant, polymeric film base, (b) an image receiving layer present upon a first surface of the film base, and (c) a layer of electrically conductive prime coat interposed between the image receiving layer and the film base. This sheet material can be used in either powder-toned or liquid-toned plain paper copiers for making transparencies, reference U.S. Pat. No. 4,711,816, the disclosure of which is totally incorporated herein by reference.

Additionally, known is a transparency to be imaged as a copy sheet in plain paper copiers which transparency contains a transparent sheet having a surface adapted to receive an image imprinted thereon in a suitable electrostatic imaging apparatus and an opaque coating forming an opaque border completely around the sheet, reference U.S. Pat. No. 4,637,974, the disclosure of which is totally incorporated herein by reference Moreover, known is the preparation of transparencies by electrostatic means, reference U.S. Pat. No. 4,370,379, the disclosure of which is totally incorporated herein by reference, wherein there is described the transferring of a toner image to a polyester film containing, for example, a substrate and a biaxially stretched poly(ethylene terephthalate) film, including Mylar. Furthermore, in U.S. Pat. No. 4,234,644, the disclosure of which is totally incorporated herein by reference, there is disclosed a composite lamination film for electrophoretically toned images deposited on a plastic dielectric receptor sheet comprising in combination an optically transparent flexible support layer, and an optically transparent flexible intermediate layer of a heat softenable film applied to one side of the support; and wherein the intermediate layer possesses adhesion to the support.

With further respect to the prior art, there are illustrated in U.S. Pat. No. 4,370,379, the disclosure of which is totally incorporated herein by reference, transparencies with, for example, a polyester (Mylar) substrate with a transparent plastic film substrate 2, and an undercoating layer 3 formed on at least one surface of the substrate 2, and a toner receiving layer 4 formed on the undercoated layer, reference column 2, line 44. As coatings for layer 3, there can be utilized the resins as illustrated in column 3, including quaternary ammonium salts, while for layer 4 there can be selected thermoplastic resins having a glass transition temperature of from a minus 50° to 150° C., such as acrylic resins, including ethylacrylate, methylmethacrylate, and propyl methacrylate; and acrylic acid, methacrylic acid, maleic acids, and fumaric acid, reference column 4, lines 23 to 65. At line 61 of this patent, there is mentioned that thermoplastic resin binders other than acrylic resins can be selected, such as styrene resins, including polystyrene, and styrene butadiene copolymers, vinyl chloride resins, vinylacetate resins, and solvent soluble linear polyester resins. A similar teaching is present in U.S. Pat. No. 4,480,003 wherein there is disclosed a transparency film comprised of a film base coated with an image receiving layer containing thermoplastic transparent polymethacrylate polymers, reference column 2, line 16, which films are useful in plain paper electrostatic copiers. Other suitable materials for the image receiving layer include polyesters, cellulosics, poly(vinyl acetate), and acrylonitrilebutadiene-styrene terpolymers, reference column 3, lines 45 to 53. Similar teachings are present in U.S. Pat. No. 4,599,293, wherein there is described a toner transfer film for picking up a toner image from a toner treated surface, and affixing the image, wherein the film contains a clear transparent base and a layer firmly adhered thereto, which is also clear and transparent, and is comprised of the specific components as detailed in column 2, line 16. Examples of suitable binders for the transparent film that are disclosed in this patent include polymeric or prepolymeric substances, such as styrene polymers, acrylic, and methacrylate ester polymers, styrene butadienes, isoprenes, and the like, reference column 4, lines 7 to 39. The coatings recited in the aforementioned patent contain primarily amorphous polymers which usually do not undergo the desired softening during the fusing of the xerographic imaging processes such as the color process utilized in the Xerox Corporation 1005 TM, and therefore these coatings do not usually aid in the flow of pigmented toners. This can result in images of low optical density which are not totally transparent.

Ink jet recording methods and ink jet transparencies thereof are known. There is disclosed in U.S. Pat. No. 4,446,174 an ink jet recording method for producing a recorded image on an image receiving sheet with aqueous inks, and wherein an ink jet is projected onto an image receiving sheet comprising a surface layer containing a pigment, which surface layer is capable of adsorbing a coloring component present in the aqueous ink. Also, there is disclosed in U.S. Pat. No. 4,371,582 an ink jet recording sheet containing a latex polymer, which can provide images having excellent water resistance properties and high image density by jetting them onto an aqueous ink containing a water soluble dye. Similarly, U.S. Pat. No. 4,547,405 describes an ink jet recording sheet comprising a transparent support with a layer comprising 5 to 100 percent by weight of a coalesced block copolymer latex of poly(vinyl alcohol) with polyvinyl(benzyl ammonium chloride), and 0 to 95 percent by weight of a water soluble polymer selected from the group consisting of poly(vinyl alcohol), poly(vinyl pyrrolidone), and copolymers thereof. In the '405 patent there is also disclosed an ink jet recording sheet comprising a layer which includes poly(vinyl pyrrolidone). A support is also disclosed in the '405 patent, which support may include polycarbonates, see column 4, line 62, for example. The disclosures of each of the aforementioned patents are totally incorporated herein by reference.

In U.S. Pat. No. 4,680,235 there is disclosed an ink jet recording material with image stabilizing agents, see column 4, lines 32 to 58, for example. Also, in column 4, line 57, for example, this patent discloses the use of a plasticizer in a surface recording layer. Further, in U.S. Pat. No. 4,701,837 there is disclosed a light transmissive medium having a crosslinked polymer ink receiving layer; and U.S. Pat. No. 4,775,594 describes an ink jet transparency with improved wetting properties.

Other coatings for ink jet transparencies include blends of carboxylated polymers with poly(alkylene glycol), reference U.S. Pat. No. 4,474,850; blends of poly(vinyl pyrrolidone) with matrix forming polymers such as gelatin; or poly(vinyl alcohol), swellable by water and insoluble at room temperature but soluble at elevated temperatures, reference U.S. Pat. No. 4,503,111; and blends of poly(ethylene oxide) with carboxymethyl cellulose as illustrated in U.S. Pat. No. 4,592,954, mentioned herein, the disclosure of each of the aforementioned patents being totally incorporated herein by reference.

Moreover, in U.S. Pat. No. 4,592,954, mentioned herein, the disclosure of which is totally incorporated herein by reference, there is illustrated a transparency for ink jet printing comprised of a supporting substrate and thereover a coating of a blend of carboxymethyl cellulose, and polyethylene oxides. Also, in this patent there is illustrated a transparency wherein the coating is comprised of a blend of hydroxypropylmethyl cellulose and poly(ethylene glycol monomethyl ether), a blend of carboxy methyl cellulose and poly(vinyl alcohol), or a blend of hydroxyethyl cellulose and vinyl pyrrolidone/diethylamino methylmethacrylate copolymer. One disadvantage associated with the transparencies of U.S. Pat. No. 4,592,954 is their insufficient resistance to relative humidities of, for example, exceeding 50 percent at 80° F. which leads to the onset of blooming and bleeding of colors in the printed text or graphics only in four to six hours. These and other disadvantages are avoided or minimized with the transparencies of the present invention in embodiments thereof.

In U.S. Pat. No. 4,865,914, the disclosure of which is toally incorporated herein by reference, there are illustrated ink jet transparencies comprised of a supporting substrate and thereover a blend comprised of poly(ethylene oxide) and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide-acrylic acid copolymer; (6) cellulose sulfate; (7) poly(2-acrylamido-2-methyl propane sulfonic acid); (8) poly(vinyl alcohol); (9) poly(vinyl pyrrolidone); and (10) hydroxypropyl methyl cellulose. One of the disadvantages of the transparencies based on binary blends of carboxymethyl cellulose, with poly(ethylene oxide) cited in U.S. Pat. No. 4,592,954 and ternary blends of carboxymethyl cellulose, poly(ethylene oxide), hydroxypropyl cellulose or ternary blends of carboxymethylcellulose, poly(ethylene oxide), vinylmethylether/maleic acid copolymer cited in U.S. Pat. No. 4,865,914 is the shift of the bluish-black color to reddish-black when printed with, for example, a Hewlett Packard Desk Jet printer.

In copending application U.S. Pat. No. 4,956,225, there are disclosed transparencies suitable for electrographic and xerographic imaging comprised of a polymeric substrate with a toner receptive coating on one surface thereof, which coating is comprised of blends of poly(ethylene oxide) and carboxymethyl cellulose; poly(ethylene oxide), carboxymethyl cellulose and hydroxypropyl cellulose; poly(ethylene oxide) and vinylidene fluoride/hexafluoropropylene copolymer, poly(chloroprene) and poly(α-methylstyrene); poly(caprolactone) and poly(α-methylstyrene); poly(vinylisobutylether) and poly(α-methylstyrene); blends of poly(caprolactone) and poly(p-isopropyl α-methylstyrene); blends of poly(1,4-butylene adipate) and poly(α-methylstyrene); chlorinated poly(propylene) and poly(α-methylstyrene); chlorinated poly(ethylene) and poly(α-methylstyrene); and chlorinated rubber and poly(α-methylstyrene). Further in another aspect of the copending application U.S. Pat. No. 4,956,226, the disclosure of which is totally incorporated herein by reference, there are provided transparencies suitable for electrographic and xerographic imaging processes comprised of a supporting polymeric substrate with a toner receptive coating on one surface thereof comprised of (a) a first layer coating of a crystalline polymer selected from the group consisting of poly(chloroprene), chlorinated rubbers, blends of poly(ethylene oxide), and vinylidene fluoride/hexafluoropropylene copolymers, chlorinated poly(propylene), chlorinated poly(ethylene), poly(vinylmethyl ketone), poly(caprolactone), poly(1,4-butylene adipate), poly(vinylmethyl ether), and poly(vinyl isobutylether); and (b) a second overcoating layer comprised of a cellulose ether selected from the group consisting of hydroxypropyl methyl cellulose, hydroxypropyl cellulose, and ethyl cellulose.

In a copending application U.S. Pat. No. 5,006,807, the disclosure of which is totally incorporated here by reference, there is disclosed a transparency comprised of a hydrophilic coating and a plasticizer, which plasticizer can, for example, be selected from the group consisting of phosphates, substituted phthalic anhydrides, glycerols, glycols, substituted glycerols, pyrrolidinones, alkylene carbonates, sulfolanes, and stearic acid derivatives.

In another copending application U.S. Pat. No. 5,068,140, the disclosure of which is totally incorporated here by reference, there is disclosed a transparent substrate material for receiving or containing an image comprised of a supporting substrate, an anticurl coating layer or coatings thereunder, and an ink receiving layer thereover.

In copending application U.S. Pat. No. 4,997,697, the disclosure of which is totally incorporated here by reference, there is disclosed a transparent substrate material for receiving or containing an image and comprised of a supporting substrate base, an antistatic polymer layer coated on one or both sides of the substrate and comprised of hydrophilic cellulosic components, and a toner receiving polymer layer contained on one or both sides of the antistatic layer, which polymer is comprised of hydrophobic cellulose ethers, hydrophobic cellulose esters or mixtures thereof, and wherein the toner receiving layer contains adhesive components.

In copending application U.S. Ser. No. 370,677, now U.S. Pat. No. 5,139,903, the disclosure of which is totally incorporated here by reference, there is disclosed an image transparency comprised of a supporting substrate, oil absorbing layer comprised of, for example, chlorinated rubber, styrenediene copolymers, alkylmethacrylate copolymers, ethylene-propylene copolymers, sodium carboxymethyl cellulose or sodium carboxymethylhydroxyethyl cellulose; an ink receiving polymer layer comprised of, for example, vinyl alcohol-vinyl acetate, vinyl alcohol-vinyl butyral or vinyl alcohol-vinylacetate-vinyl chloride copolymers. The ink receiving layers may include therein or thereon fillers such as silica, calcium carbonate, titanium dioxide.

In copending application U.S. Pat. No. 5,075,153, the disclosure of which is totally incorporated here by reference, there is disclosed a never-tear coated paper comprised of a plastic supporting substrate, a binder layer comprised of polymers selected from the group consisting of (1) hydroxypropyl cellulose, (2) poly(vinyl alkyl ether), (3) vinyl pyrrolidone-vinyl acetate copolymer, (4) vinyl pyrrolidone-dialkylamino ethyl methacrylate copolymer quaternized, (5) poly(vinyl pyrrolidone); (6) poly(ethylene imine), and mixtures thereof; and a pigment or pigments; and an ink receiving polymer layer.

Also, in copending application U.S. Pat. No. 5,137,773, the disclosure of which is totally incorporated here by reference, there are disclosed all purpose xerographic transparencies with coatings thereover which are compatible with the toner compositions selected for development, and wherein the coatings enable images thereon with acceptable optical densities to be obtained. More specifically, in one embodiment of the copending application there are provided transparencies for ink jet printing processes and xerographic printing processes, which transparencies are comprised of a supporting substrate and a coating composition thereon comprised of a mixture selected from the classes of materials comprised of (a) nonionic celluloses such as hydroxylpropylmethyl cellulose, hydroxyethyl cellulose, hydroxybutyl methyl cellulose, or mixtures thereof; (b) ionic celluloses such as anionic sodium carboxymethyl cellulose, anionic sodium carboxymethyl hydroxyethyl cellulose, cationic celluloses, or mixtures thereof; (c) poly(alkylene oxide) such as poly(ethylene oxide) together with a noncellulosic component selected from the group consisting of (1) poly(imidazoline) quaternized; (2) poly(N,N-dimethyl-3,5-dimethylene piperidinium chloride); (3) poly(2-acrylamido-2-methyl propane sulfonic acid); (4) poly(ethylene imine) epichlorohydrin; (5) poly(acrylamide)l; (6) acrylamide-acrylic acid copolymer; (7) poly(vinyl pyrrolidone); (8) poly(vinyl alcohol); (9) vinyl pyrrolidone-diethyl aminomethylmethacrylate copolymer quaternized; (10) vinyl pyrrolidone-vinyl acetate copolymer; and mixtures thereof. The aforementioned coating compositions are generally present on both sides of a supporting substrate, and in one embodiment the coating is comprised of nonionic hydroxyethyl cellulose, 25 percent by weight, anionic sodium carboxymethyl cellulose, 25 percent by weight, poly(ethylene oxide), 25 percent by weight, and poly(acrylamide), 25 percent by weight. Also, the coating can contain colloidal silica particles, a carbonate, such as calcium carbonate, and the like primarily for the purpose of transparency traction during the feeding process. In one embodiment, the coating composition can thus be comprised of a mixture of nonionic hydroxyethyl cellulose, 25 percent by weight, nonionic hydroxypropyl methyl cellulose, 20 percent by weight, anionic sodium carboxymethyl cellulose, 20 percent by weight, poly(ethylene oxide), 20 percent by weight, acrylamide-acrylic acid copolymer, 12 percent by weight, and colloidal silica, 3 percent by weight.

In another embodiment of the aforementioned copending application, there is disclosed, for example, a transparent substrate material for receiving or containing an image comprised of a supporting substrate and a coating composition comprised of a mixture of (a) nonionic celluloses and blends thereof; (b) ionic celluloses and blends thereof; (c) poly(alkylene oxide); and an additional non cellulosic component selected from the group consisting of (1) poly(imidazoline) quaternized; (2) poly(N,N-dimethyl-3,5-dimethylene piperidinium chloride); (3) poly(2-acrylamido-2-methyl propane sulfonic acid); (4) poly(ethylene imine) epichlorohydrin; (5) poly(acrylamide); (6) acrylamide-acrylic acid copolymer; (7) poly(vinyl pyrrolidone); (8) poly(vinyl alcohol); (9) vinyl pyrrolidone-diethyl aminomethyl methacrylate copolymer quaternized; (10) vinyl pyrrolidone-vinyl acetate copolymer; and mixtures thereof.

Although the transparencies illustrated in the prior art are suitable in most instances for their intended purposes, there remains a need for new transparencies with coatings thereover, which transparencies are useful in electrophotographic and xerographic imaging processes, and that will enable the formation of images with high optical densities. Additionally, there is a need for transparencies which permit improved ink and toner flow in the imaged areas thereby enabling high quality transparent images with acceptable optical densities. There is also a need for transparencies that possess other advantages, inclusive of enabling excellent adhesion between the toned image and the transparency selected, and wherein images with excellent resolution and no background deposits are obtained. Another feature of the present invention resides in providing transparencies with coatings that do not (block) stick at, for example, high relative humidities of, for example, 50 to 75 percent relative humidity and at a temperature of 50° C. in many embodiments. Moreover, in another feature of the present invention there are provided transparencies with polymer coatings possessing a high degree of crystallinity and a sharp melting point enabling these coatings to effectively soften during fusing thereof, especially in xerographic imaging and printing apparatuses, and also permitting transparencies that can enhance toner flowability.

SUMMARY OF THE INVENTION

It is a feature of the present invention to provide transparencies with many of the advantages illustrated herein.

Another feature of the present invention resides in the provision of transparencies with certain coatings, which transparencies are useful in electrophotographic imaging processes, dot matrix printers and ink jet printers.

Also, in another feature of the present invention there are provided transparencies with certain coatings thereover enabling images thereon with high optical densities, and wherein increased toner flow is obtained when imaged, for example, with commercially available xerographic imaging apparatuses and ionographic printers, inclusive of printers commercially available from Delphax such as the Delphax S-6000.

Moreover, another feature of the present invention resides in imaged transparencies that have substantial permanence for extended time periods.

Another feature of the present invention resides in the provision of transparencies for xerographic or electrographic systems such as the Xerox Corporation 1005 TM imaging apparatus, the Xerox Corporation 1005 TM imaging apparatus, the Xerox Corporation 1025 TM imaging apparatus, or the Xerox Corporation 1075 TM imaging apparatus.

Additionally, in another feature of the present invention there are provided transparencies with, for example, blends of coatings on a supporting substrate.

Furthermore, in another feature of the present invention there are provided coatings for electrophotographic, especially xerographic, transparencies, which coatings in an embodiment are comprised of a hydrophilic/hydophobic segment with block copolymers of ethylene oxide/propylene oxide surfactants in combination with known binder polymers, such as cellulose acetate hydrogen phthalate, chlorinated rubber, hydroxy propyl methyl cellulose phthalate styrene butadiene, vinyl alcohol/vinyl acetate, cellulose acetate, ethyl cellulose, mixtures thereof in some instances, and the like.; one advantage of the aforementioned surfactants residing in their sharp melting point, in some instances enabling enhanced toner flowability; and further the coating is not of sufficient water solubility, and normally static build up on the transparencies is avoided or minimized.

These and other features of the present invention can be accomplished in embodiments thereof by providing transparancies with coatings thereover. In accordance with one embodiment of the present invention, there are provided xerographic transparencies with coatings thereover which are compatible with the toner compositions selected for development, and wherein the coatings enable substantially static free images thereon with acceptable optical densities to be obtained. More specifically, in one embodiment of the present invention there are provided transparencies for xerographic printing processes, which transparencies are comprised of a supporting substrate and an ink or toner receiving coating composition on the two exposed surfaces, or both sides of the substrate and comprised of an adhesive layer polymer such as chlorinated poly(isoprene), chlorinated poly(propylene), blends of antistatic plasticizers such as, phosphate esters with poly(styrene) and the like, and an antistatic layer on each exposed surface of the adhesive layer which antistatic layer is comprised of complexes or mixtures of metal halides such as potassium iodide with polymers containing oxyalkylene units or segments, or urea compounds such as urea or urea phosphate with polymers containing oxyalkylene units such as poly(ethylene oxide), poly(propylene oxide), ethylene oxide/propylene oxide block copolymers, ethoxylated amines and the like, and an optional resin binder polymer such as poly(2-hydroxyethylmethacrylate), poly(2-hydroxypropylmethacrylate), hydroxypropylmethyl cellulose and the like.

Embodiments of the present invention include a transparency comprised of a supporting substrate such as polyester and an ink or toner receiving coating composition present on both sides of the substrate and comprised of an adhesive layer polymer such as poly(alkenes), halogenated poly(alkenes), halogenated poly(dienes), styrene/isoprene copolymers, ethylene/vinyl acetate copolymer, styrene/isobutylene copolymers, ethylene/ethyl acrylate copolymers, styrene/ethylene butylene copolymers, styrene/ethylene oxide copolymers, ϵ-caprolactone/ethylene oxide copolymers, ethylene sulfide/ethylene oxide copolymer, ethylene terephthalate/ethylene oxide copolymers; blends of from about 99 to about 50 percent by weight of (a) ethyl cellulose, ethyl hydroxyethyl cellulose, poly(styrene), substituted poly(styrenes), poly(2-vinyl pyridine), chlorinated poly(isoprene), styrene/butadiene, acrylonitrile/butadiene, styrene/allylalcohol, styrene/butylmethacrylate, methylmethacrylate/butadiene/styrene, acrylonitrile/butadiene/styrene; and (b) from about 1 to about 50 per cent by weight of a low molecular weight antistatic plasticizer selected from the group consisting of alkanol amides, amine ethoxylates, imidazolines, quaternized imidazolines, sodium dialkyl sulfosuccinates, phosphate esters, and alkanolamide ethoxylates, which adhesives can be dissolved in a solvent such as toluene in a concentration of 0.25 to about 5 percent by weight; and an antistatic layer on both sides, for example on each side of the exposed adhesive layer, which antistatic layer is comprised of complexes or mixtures of metal halides such as potassium iodide, sodium iodide, lithium bromide, zinc chloride, magnesium chloride, mercuric chloride, cadmium chloride, and urea compounds such as urea, thiourea, urea monohydrochloride, urea sulfate, urea phosphate both with oxyalkylene containing polymers such as poly(methylene oxide), poly(ethylene oxide), poly(propylene oxide), poly(tetramethylene oxide), poly(epichlorohydrin) poly(ethylene succinate), poly(ethylene adipate), ethylene oxide/propylene oxide block copolymers, alkanol amides, poly(ethylene glycol) fatty acid esters, sorbitan ester ethoxylates, ethoxylated amines, fatty imidazolines, castor oil ethoxylates, alkanol amide ethoxylates, fatty acid ethoxylates, alcohol ethoxylates, alcohol alkoxylate, nonyl phenol ethoxylates, octylphenol ethoxylates, silicone poly alkoxylate block copolymers, quatenary ammonium copolymers of poly(ethylene oxide), poly(-propylene glycol dimethacrylate), poly(ethylene glycol diacrylate), poly(ethylene glycol monomethyl ether), poly(ethylene glycol dimethyl ether), poly(ethylene glycol diglycidyl ether), ethylene oxide/2-hydroxyethyl methacrylate/ethylene oxide block copolymers, ethylene oxide/hydroxypropyl methacrylate/ethylene oxide block copolymers, ethylene oxide/4-vinyl pyridine/ethylene oxide block copolymers, ionene/ethylene oxide/ionene triblock copolymers, ethylene oxide/isoprene/ethylene oxide copolymer, all dissolved in methanol in a concentration of from about 1 to about 5 percent by weight and an optional resin binder polymer such as cellulose acetate hydrogen phthalate, hydroxypropylmethyl cellulose acetate succinate, hydroxypropylmethyl cellulose phthalate, poly(-diallyl phthalate), cellulose acetate butyrate, cellulose propionate dissolved in an aromatic solvent such as acetone in a concentration of from about 1 to about 5 percent by weight, vinyl alcohol/vinyl acetate copolymer, vinyl alcohol/vinyl butyral copolymer, vinyl pyrrolidone/vinyl acetate copolymer, poly(n-butylmethacrylate), poly(isobutylmethacrylate), n-butylmethacrylate/isobutylmethacrylate copolymer, poly(2-hydroxyethylmethacryalte), poly(2-hydroxypropyl methacrylate), styrene/maleic anhydride copolymer, poly(4-vinyl pyridine), poly(vinyl butyral), ethyl cellulose, hydroxypropyl cellulose, hydroxy propyl methyl cellulose, or hydroxy propyl butyl cellulose dissolved in an alcoholic solvent, such as methanol in a concentration of about 1 to about 5 percent by weight.

Another embodiment of the present invention is directed to transparencies comprised of a supporting substrate such as polyester (Mylar) with a thickness of from about 50 to about 150 microns with a coating composition on both sides, or surfaces thereof comprised in an effective thickness of from, for example, about 1 to about 10 microns of an adhesive polymer such as chlorinated poly(isoprene), and an antistatic layer on both sides, that is each of the exposed surfaces, a total of two, of the adhesive layer comprised in an effective thickness of from, for example, about 1 to about 5 microns of a mixture of complexes of metal halides such as potassium iodide or urea compounds, each with oxyalkylene unit containing polymers such as poly(ethylene oxide) and an optional resin binder polymer such as poly(2-hydroxyethyl methacrylate), hydroxypropylmethyl cellulose, the ratio of the oxyalkylene unit containing polymer to the metal halides or urea being in the range of from about 0.001 to about 4.0 and the concentration of these complexes in the antistatic layer being in the range of from about 1 to about 20 percent by weight with the binder polymer being present in a concentration of from about 99 to about 80 percent by weight.

Illustrative examples of adhesive polymers include poly(ethylene), Brookfield viscosity at 140° C., of between 40 to 6,000 CPS; poly(propylene), atactic Brookfield viscosity at 191° C. ranging between 200 CPS to 4425 CPS, and a softening point between 121° C. to 150° C., poly(1-butene), isotactic weight average molecular weight of between 185,000 and 570,000; chlorinated poly(ethylene) with a chlorine content between 25 and 75 percent by weight; chlorinated poly(propylene) with a chlorine content between 25 and 75 percent by weight; chlorosulfonated poly(ethylene) chlorine content between 25 and 75 percent by weight, and a sulfur content as chlorosulfone of between 0.5 to 1.65 percent by weight; chlorinated poly(isoprene) with a chlorine content from about 25 to about 75 percent by weight; poly(chloroprene) with a chlorine content between 25 to about 75 percent by weight and a Mooney viscosity between 40 and 120; styrene/isoprene, styrene/isobutylene, styrene/ethylene butylene, ethylene oxide/-styrene/ethylene oxide copolymers (synthesized using dianion of α-methylstyrene at −80° C.) with a styrene content ranging from about 10 to about 90 percent by weight; known caprolactone/ethylene oxide/caprolatone triblock copolymers which can be prepared using conventional polymerization techniques described in *Block Copolymers* by Allen Noshay and James E. McGrath, Academic Press, 1977, the disclosure of which is totally incorporated herein by reference, by initiating caprolactone polymerization with the sodium salt of a preformed dihydroxyl-terminated poly(ethylene oxide) oligomer at 60° C. in benzene as solvent; ethylene sulfide/ethylene oxide diblock copolymer which can be synthesized via initiation with potassium carbazyl of ethylene oxide segment first and then adding the monomer ethylene sulfide; ethylene oxide/ethylene terephthalate copolymers which can be synthesized by the melt condensation of dimethyl terephthalate, ethylene glycol, and hydroxyl terminated poly(ethylene oxide) in the presence of lead oxide with an ethylene oxide content of from about 25 to about 75 percent by weight; ethylene/vinyl acetate, ethylene/ethylacrylate copolymers with an ethylene content ranging from about 25 to about 90 percent by weight; blends of low molecular weight antistatic plasticizers such as coconut diethanol amide, lauric diethanol amide, ethoxylated tallow amines with hydrophilic/lyophilic balance (HLB) values of from about 4 to about 9, coconut hydroxyethylimidazoline, oleic hydroxyethyl imidazoline, tall oil hydroxyethyl imidazoline, imidazoline quaternized, sodium dioctyl sulfosuccinate, sodium diisobutyl sulfosuccinate, sodium dihexyl sulfosuccinate, ethoxylated coconut monoethanolamine, aliphatic phosphate esters, aromatic phosphate esters in a concentration of from about 1 to about 50 percent by weight, with an ethyl cellulose-ethoxyl content between 46 and 50 percent by weight, ethylhydroxyethyl cellulose, poly(styrene) weight average molecular weight from about $5.0\times10^4$ to about $1.0\times10^6$, poly(α-methyl styrene), poly(p-methyl styrene), poly(p-isopropyl styrene), poly(p-terbutyl styrene), poly(p-isopropyl α-methylstyrene), poly(p-chlorostyrene), poly(p-bromostyrene), poly(p-methoxystyrene) with a molecular weight between $1.0\times10^4$ to $5.0\times10^5$, styrene/-butadiene, styrene/allylalcohol, styrene/n-butyl methacrylate copolymers where the styrene content is from about 50 to about 95 percent by weight, acrylonitrile/-butadiene copolymers with a butadiene content of from about 10 to about 50 percent by weight, methyl methacrylate/styrene copolymers where the styrene content is from about 10 to about 80 percent by weight, and the butadiene content is from about 60 to about 15 percent by weight, the methyl methacrylate and acrylonitrile content is from about 30 to about 5 percent by weight in a concentration of from about 99 to about 50 percent by weight. The preferred adhesive layer polymers in embodiments of the present invention are comprised of chlorinated poly(isoprene), chlorinated poly(propylene), blends of poly(styrene) with low molecular weight antistatic plasticizers such as alkanol amide, blends of poly(α-methyl styrene) with ethoxylated amines because of the excellent toner adhesion with the coating of these polymers and these are commercially available at lower costs in most instances.

Incorporation of the antistatic plasticizers in certain adhesive layers has at least a two fold effect in embodiments of the present invention: (a) promotion of poly(styrene) type coatings to adhere better to Mylar and (b) avoiding static build-up on the poly(styrene) based adhesive layer thereby facilitating the application of the antistatic layer on the top of adhesive layer from a volatile flammable organic solvent such as methanol or acetone and preventing fire hazards when the undercoats (adhesive) and overcoats (antistatic layers) are being applied to Mylar on commercial coater.

Illustrative examples of the aforementioned antistatic layer materials include metal halides such as potassium iodide, 99 percent pure A.C.S. reagent, sodium iodide anhydrous, 99+ percent pure, lithium bromide, anhydrous, 99+ percent, zinc chloride A.C.S. reagent grade, magnesium chloride anhydrous, mercuric chloride, 99+ percent A.C.S. reagent grade, cadmium chloride, anhydrous A.C.S. reagent grade, complexed with polymers as indicated herein, or urea compounds such as urea, 99.9 percent pure Gold label, thiourea, 99+ percent pure A.C.S. reagent Gold label, urea monohydrochloride, urea phosphate, 98 percent pure and urea sulfate, 97 percent pure, complexed with polymers. The metal halides and urea compounds are commercially available with Aldrich Chemicals being one of the sources. The antistatic layer includes polymers containing oxyalkylene units such as poly(methylene oxide) with a melting point of 175° C., poly(ethylene oxide) with an average molecular weight of from $1.0\times10^3$ to about $1.0\times10^6$, melting point 65° C., poly(propylene oxide) with an average molecular weight of from about 1.0 to $10^3$ to about $1.0\times10^4$, poly(tertramethylene oxide) with an average molecular weight of from about 650 to about $1.0\times10^4$, poly(ethylene adipate) with an average molecular weight of from about $5.0\times10^3$ to about $5.0\times10^4$ with a melting point of 55° C., poly(ethylene succinate) with an average molecular weight of from about $5.0\times10^3$ to about $5.0\times10^4$, poly(epichlorohydrin) with an average molecular weight of from about $5.0\times10^4$ to about $1.0\times10^6$, ethylene oxide/propylene oxide copolymers such as ethylene oxide/propylene oxide/ethylene oxide triblock copolymer, propylene oxide/ethylene oxide/propylene oxide triblock copolymer, tetrafunctional block copolymer derived from the sequential addition of ethylene oxide and propylene oxide to ethylene diamine, the content of ethylene oxide in these block copolymers being from about 5 to about 95 percent by weight, alkanol amides such as coconut diethanol amide, lauric diethanol amide, poly(ethylene glycol) ditallow esters with HLB values of 11.5, poly(ethylene glycol) mono laurate with a HLB value of 12.8, poly oxyethylene sorbitan mono laurate with a HLB value of 16.7, poly oxyethylene sorbitan mono oleate with a HLB value of 15.0, ethoxylated tallow amines with HLB values of between 4 and 9, castor oil ethoxylates such as ethoxylated triglycerides, alkanolamide ethoxylates such as ethoxylates of coconut monoethanolamides, fatty acid ethoxylates where the fatty radical can be oleate or a laurate, with HLB values of between 10 and 15, ethoxylated alcohols and alkoxylated alcohols with HLB values from about 4.0 to about 17.0, octyl and nonyl phenol ethoxylates with HLB values from 3.5 to about 18.7, silicone poly alkoxylate block copolymers such as ethylene oxide/dimethyl siloxane diblock copolymers, ethylene oxide/dimethyl siloxane/ethylene oxide triblock copolymers, dimethylsiloxane/ethylene oxide/propylene oxide triblock copolymers, dimethyl siloxane/methyl siloxane alkylene oxide diblock copolymers where alkylene is ethylene, propylene or ethylene-propylene, water or alcohol soluble block copolymers with a weight average molecular weight of, for example, from about 1,000 to about 5,000 and dimethyl siloxane content of from about 15 to about 80 percent by weight, quaternary ammonium copolymers of poly(ethylene oxide) such as di-fatty quaternary alkoxylate, ureylene quaternary polymer with average degree of polymerization equal to 6 and synthesized by the condensation of 3, dimethylamino propylamine with phosgene and reacting the resulting product with 2-chloroethylether, replacement of phosgene by adipoyl chloride or sebacoyl chloride provides other quaternary ammonium polymers with an average degree of polymerization of about 100, poly(propylene glycol dimethacrylate) with an average molecular weight of from about 400 to about 4,000, poly(ethylene glycol diacrylate) with an average molecular weight of from about 200 to about 4,000, poly(ethylene glycol monomethyl ether) and poly(ethylene glycol dimethyl ether) with an average molecular weight of from about 400 to about 2,000, poly(ethylene glycol diglycidyl ether) with an average molecular weight of from about 200 to about 600, ethylene oxide/2-hydroxyethyl methacrylate/ethylene oxide and ethylene oxide/hydroxypropyl methacrylate/ethylene oxide triblock copolymers which can be synthesized via free radical polymerization of hydroxyethyl methacrylate or hydroxypropyl methacrylate with 2-aminoethanethiol using α, α' azobisisobutyronitrile as initiator and reacting the resulting amino-semitelechelic oligo-hydroxyethyl methacrylate or amino-hydroxypropyl methacrylate with an isocyanate-polyethylene oxide complex in chlorobenzene at 0° C., and precipitating the reaction mixture in diethylether, filtering and drying in vaccum, ethylene oxide/4-vinyl pyridine/ethylene oxide triblock copolymers which can be synthesized via anionic polymerization of 4-vinyl pyridine with sodium naphthalene as initiator at −78° C. and then adding ethylene oxide monomer, the reaction being carried out in an explosion proof stainless steel reactor; ionene/ethylene oxide/ionene triblock copolymers which can be synthesized via quaternization reaction of one end of each 3-3 ionene with the halogenated (preferably brominated) poly(oxyethylene) in methanol at about 40° C., ethylene oxide/isoprene/ethylene oxide triblock copolymers which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymers being from about 20 to about 20 percent by weight and preferably about 50 percent by weight. The preferred oxyalkylene containing polymers can be poly(ethylene oxide), ethylene oxide/propylene oxide block copolymers, alkanol amides, and ethoxylated amines primary because of their availability and lower cost.

Illustrative examples of the resin binders present in the antistatic layer in combination with the antistatic complexes of metal halides, and urea compounds with polymers containing oxyalkylene units include hydroxypropylmethyl cellulose phthalate with free phthalic acid from about 0.5 to about 0.7 percent by weight, carboxybenzoyl groups from about 21.5 to about 32.25 percent by weight, methoxyl groups from about 19.85 to about 22.25 percent by weight, hydroxypropyl groups from about 6.15 to about 7.45 percent by weight; hydroxypropylmethyl cellulose acetate succinate with a methoxyl content from about 20.0 to about 26.0 percent by weight, hydroxypropyl content from about 5.0 to about 10.0 percent by weight, acetyl content from about 5.0 to about 14.0 percent by weight, succinoyl content from about 18.0 to about 4 percent by weight, cellulose acetate hydrogen phthalate with free phthalic acid from about 3.5 to about 21.0 percent by weight, carboxybenzoyl groups from about 32.5 to about 20.5 percent by weight and acetyl groups from about 21.8 to about 13.85 percent by weight, poly(diallyl phthalate) with a melting point of about 85° C., and average molecular weight between $5.0\times10^4$ to about $1.0\times10^5$; cellulose acetate butyrate with a butyl content of from about 12.0 to about 20.0 percent by weight, acetyl content from about 30.0 to about 22.0 percent by weight, hydroxyl content between 1.0 to about 2.0 percent by weight, weight average molecular weight from about $1.0\times10^4$ to about $5.0\times10^5$; cellulose propionate with a weight average molecular weight of from about $1.0\times10^4$ to about $5.0\times10^5$, vinyl alcohol/vinyl acetate copolymer and vinyl alcohol/vinyl butyral copolymer with average molecular weight from about $1.0\times10^4$ to about $5.0\times10^5$ and a vinyl content of from about 5 to about 35 percent by weight; vinyl pyrrolidone/vinyl acetate copolymer with an average molecular weight of from about $2.0\times10^3$ to about $2.0\times10^4$ with a vinyl acetate content of from about 25 to about 75 percent by weight, poly(n-butylmethacrylate) with an average molecular weight of from about $1.0\times10^4$ to about $5.0\times10^5$, poly(isobutyl methacrylate) with an average molecular weight of from about $2.0\times10^4$ to about $4.0\times10^5$, n-butyl methacrylate/isobutyl methacrylate copolymer with an average molecular weight of from about $1.5\times10^4$ to about $4.5\times10^5$ and with n-butyl methacrylate content of from about 25 to about 75 percent by weight, poly(2-hydroxyethyl methacrylate) and poly(2-hydroxy propylmethacrylate) with average molecular weight of from about $1.0\times10^5$ to about $1.0\times10^6$, styrene/maleic anhydride copolymer with a number average molecular weight of from about $1.5\times10^3$ to about $5.0\times10^3$ and a styrene content of from about 25 to about 75 percent by weight, poly(4-vinyl pyridine) with an average molecular weight of from about $5.0\times10^4$ to about $5.0\times10^5$, poly(vinyl butyral) with an average molecular weight of from about $5.0\times10^4$ to about $5.0\times10^5$, ethyl cellulose with a viscosity of a 5 percent by weight-solution in 80/20 toluene/ethanol mixture being from about 4 CPS to about 300 CPS, hydroxypropyl cellulose with an average molecular weight of from about $6.0\times10^4$ to about $1.0\times10^6$, or hydroxypropyl methyl cellulose and hydroxybutylmethyl cellulose with a viscosity range of 35 CPS to 4000 CPS (1 percent solution in water). The preferred binders can be vinyl alcohol/vinyl acetate copolymer, hydroxypropyl methyl cellulose, poly(2-hydroxyethyl methacrylate), and hydroxypropyl methyl cellulose phthalate primarily because of their compatibility with the antistatic complexes, low costs in many instances, and commercial availability.

Specific examples of the adhesive layer polymers include poly(ethylene) (#042, Scientific Polymer Products), poly(propylene) atactic (#780, Scientific Polymer Products), poly(1-butene) (#337, Scientific Polymer Products); chlorinated poly(ethylene) (#327, chlorine content 48 percent by weight, Scientific Polymer Products); chlorinated poly(propylene) (#117, chlorine content 65 percent by weight, Scientific Polymer Products); chlorosulfonated poly(ethylene) (#107, chlorine content 43 percent by weight, sulfur content 1.1 percent by weight as chlorosulfone, Scientific Polymer Products); styrene/isoprene (styrene content 70 percent by weight #18351 Polysciences); styrene/isobutylene (styrene content 70 percent by weight); styrene/ethylene butylene, styrene content 29 percent by weight (Kraton 1652, Shell Company); ethylene/vinyl acetate (#785, vinylacetate content 50 percent by weight, Scientific Polymer Products); ethylene/ethylacrylate (#455, ethylacrylate content 18 percent by weight; Scientific Polymer Products); blends of ethyl cellulose (Ethocel N-100, Hercules), or ehyl hydroxyethyl cellulose (EHEC, Hercules) 80 percent by weight and ethoxylated tallow amine (Alkaminox T-5, Alkaril Chemicals) or alkanol amide (Alkamide CDE, Alkaril Chemicals 20 percent by weight in toluene; blends of poly(styrene) (#589), poly(α-methyl styrene) (#399), poly(p-methylstyrene (#315) or poly(p-tertbutylstyrene), (#177) (all available from Scientific Polymer Products) 70 percent by weight and phosphate esters (Alkaphos B6-56A, Alkaril Chemicals) or oleic hydroxyethyl imidazoline (Alkazine-0, Alkaril Chemicals) 30 percent by weight in toluene; blends of poly(p-chlorostyrene) (#257), or poly(p-bromostyrene) (#212), poly(p-methoxystyrene) (#314) (all available from Scientific Polymer Products) 80 percent by weight and imidazoline quaternized (Alkaquat-O, Alkaril Chemicals) or sodium dioctyl sulfosuccinate (Alkasurf SS-O-75, Alkaril Chemicals) 20 percent by weight in toluene; blends of styrene/butadiene (Kraton 1150, Shell Company), styrene/allyl alcohol (#393 Scientific Polymer Products), styrene/n-butyl methacrylate (#595, Scientific Polymer Products) 90 percent by weight and sodium dihexyl sulfosuccinate (Alkasurf SS-MA-80, Alkaril Chemicals) or sodium diisobutyl sulfosuccinate (Alkasurf SS-1B-45), Alkaril Chemicals) 10 percent by weight in toluene; blends of acrylonitrile/butadiene (#527 methylmethacrylate/-butadiene/styrene (BTA, Kureha Japan), or acrylonitrile/butadiene/styrene (#051, Scientific Polymer Products) 95 percent by weight and phosphate esters (Alkaphos R9-07A, Alkaril Chemicals) or alkanol amide (Alkamide 2104, Alkaril Chemicals) 5 percent by weight in toluene.

Specific examples of the antistatic layer in contact with the adhesive layer include blends of poly(ethylene oxide) (Poly OXWSRN-3000 Union Carbide) or poly(-propylene oxide) (#822, Scientific polymer products), ethylene oxide/propylene oxide block copolymer (Tetronic 50R8, BASF Corporation), 99.5 percent by weight, and potassium iodide, sodium iodide (Aldrich Chemicals) or lithium bromide (Aldrich Chemicals) or zinc chloride (Aldrich Chemicals), 0.5 percent by weight; blends of poly(oxyethylene sorbitan monolaurate) (Alkamuls PS ML-4 Alkaril Chemicals), poly(oxyethylene tallow amine) (Alkaminox T-5, Alkaril Chemicals) (Icomeen T-15, ICI Chemicals), castor oil ethoxylates (Alkasurf CO-10, Alkaril Chemicals) poly(ethylene glycol mono laurate) (Alkamuls 400-ML) 90 percent by weight and cadmium chloride (Aldrich Chemicals), or mercuric chloride (Aldrich Chemicals) 10 percent by weight; blends of coconut oil alkanolamide ethoxylates (alkamide C-2, Alkaril Chemicals), lauric acid ethoxylate (Alkasurf L-14, Alkaril Chemicals), fatty alcohol ethoxylates (Alkasurf LAN-1, Alkasurf TDA-6, Alkaril Chemicals) 85 percent by weight and urea (Aldrich Chemicals), or urea sulfate (Aldrich Chemicals), 15 percent by weight; blends of nonyl phenol ethoxylates (Alkasurf NP-1, Alkaril Chemicals), octyl phenol ethoxylates (Alkasurf OP-12, Alkaril Chemicals), quaternary ammonium copolymers (Mirapol WT, Mirapol AD-1, Mirapol A-15, Merquat-100, Miranol Incorporated), 80 percent by weight, and urea phosphate (Aldrich Chemicals), or urea monohydrochloride (Aldrich Chemicals), 20 percent by weight; blends of silicone polyalkoxylate block copolymers (PS 558, PS 555, PS 556, PS 073, PS 072, PS 071, Petrarch Systems Inc.; Alkasil HEP 182-280, Alkasil HEP 148-330, Alkasil NEP 73-70 Alkaril Chemicals), 95 percent by weight, and potassium iodide, (Aldrich Chemicals), 5 percent by weight; blends of poly(propylene glycol dimethacrylate (#4383), poly(ethylene glycol dimethacrylate) (#15178) or poly(ethylene glycol diacrylate) (#15246) (all available from Poly Sciences Inc.), 75 percent by weight, and urea, or urea sulfate, urea phosphate, urea monohydrochloride (all available from Aldrich Chemicals), 25 percent by weight; blends of poly(tetramethylene oxide) (Poly Sciences #16260), poly(ethylene glycol monomethyl ether) (#5986), poly(ethylene glycol dimethyl ether) (#17033) or poly(ethylene glycol diglycidyl ether) (#8211) (all available from Poly Sciences), 70 percent by weight, and zinc chloride, magnesium chloride, mercuric chloride or cadmium chloride (all from Aldrich Chemicals), 30 percent by weight; blends of poly(epichlorohydrin) (#127), poly(ethylene adipate) (#147), or poly(ethylene succinate) (#150) (all available from Scientific Polymer Products), 95 percent by weight, and potassium iodide or lithium bromide (both from Aldrich Chemicals), 5 percent by weight; blends of alkanol amides (Alkamide 2104, Alkaril Chemicals), alkyl hydroxyethyl imidazoline (Alkazine-0, Alkazine-C, Alkazine TO Alkaril Chemicals), quaternized imidazolines (Alkaquat-0, Alkaquat-T, Alkaril Chemicals), or alkoxylated di-fatty quaternary (Alkaquat DAET, Alkaquat-DAPT, Alkaril Chemicals), 98 percent by weight, and potassium iodide (available from Aldrich Chemicals), 2 percent by weight; blends of ethylene oxide/2-hydroxyethyl methacrylate/ethylene oxide triblock copolymers with ethylene oxide content of 70 percent by weight, or ethylene oxide/hydroxypropylmentacrylate/ethylene oxide triblock copolymer with ethylene oxide content of 80 percent by weight, or ethylene oxide/4-vinyl pyridine/ethylene oxide triblock copolymer with ethylene oxide content of 80 percent by weight, or ethylene oxide/isoprene/ethylene oxide triblock copolymer with ethylene oxide content of 90 percent by weight, or ionene/ethylene oxide/ionene triblock copolymer with ethylene oxide content of 70 percent by weight, 98 percent by weight, and potassium iodide (available from Aldrich Chemicals), 2 percent by weight; blends of cellulose acetate hydrogen phthalate (CAP, Eastman Kodak Company), or hydroxypropyl methyl cellulose phthalate (HPMCP, Shin-Etsu Chemical), or hydroxypropyl methylcellulose acetate succinate (HPMCAS, Shin-Etsu Chemical), 60 percent by weight, ethylene oxide/propylene oxide block copolymer (Tetronic 50R8, BASF Corporation), 38 percent by weight, and potassium iodide, 2 percent by weight; blends of poly(diallyl phthalate) (#010), or cellulose acetate butyrate (#077), or cellulose propionate (#321) (available from Scientific Polymer Products), 50 percent by weight, poly(ethylene oxide) (Poly OXWSRN-3000), 48 percent by weight, and sodium iodide or lithium bromide, 2 percent by weight; blends of vinyl alcohol/vinyl acetate with a vinyl alcohol content of 18 percent by weight (#380), or vinyl alcohol/vinyl butyral with a vinyl alcohol content of 19.5 percent by weight (#381), or n-vinyl pyrrolidone/vinyl acetate with a vinyl pyrrolidone content of 50 percent by weight (#367) (available from Scientific Polymer Products), 60 percent by weight, ethylene oxide/propylene oxide block copolymer (Tetronic 50R8, BASF Corporation), 38 percent by weight, and potassium iodide, 2 percent by weight; blends of vinyl alcohol/vinyl butyral copolymer with a vinyl alcohol content of 19.5 percent by weight (#381), or N-vinyl pyrrolidone/vinyl acetate with a vinyl pyrrolidone content of 50 percent by weight (#367) (all from Scientific Polymer Products), 60 percent by weight, ethylene oxide/propylene oxide block copolymer (Tetronic 50R8. BASF Corporation), 38 percent by weight, and potassium iodide, 2 percent by weight; blends of vinyl alcohol/vinyl butyral copolymer with a vinyl alcohol content of 19.5 percent by weight (#381), hydroxypropylmethyl cellulose (HPMC K35LV, Dow Chemicals), or hydroxybutylmethyl cellulose (HBMC, Dow Chemicals), or hydroxypropyl methacrylate (#232 Scientific Polymer Products), or poly(2-hydroxyethylmethacrylate) (#414 Scientific Polymer Products), 54 percent by weight, ethylene oxide/propylene oxide block copolymer (Tetronic 50 R8, BASF Corporation) or ethoxylated amines (Alkaminox T-5, Alkaril Chemicals), 38 percent by weight, and urea or urea phosphate, or urea sulfate, or urea monohydrochloride (Aldrich Chemicals), 8 percent by weight; blends of poly(n-butyl methacrylate) (#111), or poly(isobutyl methacrylate) (#112), or n-butyl methacrylate/isobutylmethacrylate copolymer with n-butyl methacrylate content of 50 percent by weight (#209) (available from Scientific Polymer Products), 60 percent by weight, and alkanol amide (Alkamide-2104, Alkaril Chemicals), or oleic hydroxyethyl imidazoline (Alkazine-0, Alkaril Chemicals), or quaternized imidazoline (Alkaquat-O), 38 percent by weight, and potassium iodide or sodium iodide or mercuric chloride or zinc chloride (all available from Aldrich Chemicals), 2 percent by weight, blends of hydroxypropyl cellulose (Klucel-E, Hercules) or ethyl cellulose (Ethocel N-100, Hercules Company) or poly(vinyl butyral) (#507, Scientific Polymer Products) or styrene/maleic anhydride with styrene content of 50 percent by weight (#456, Scientific Polymer Products), 50 percent by weight, and poly(propylene oxide) (#822, Scientific Polymer Products), or poly(oxyethylene) modified polymers, such as Alkamuls PSML-4, Alkasurf CO-10, Alkamuls 400-ML, Alkamide C-2, Alkasurf L-14, Alkasurf LAN-1, Alkasurf NP-1, Alkasurf-OP-12, Mirapol WT, PS558, Alkasil NEP 73-70, 30 percent by weight, and cadmium chloride or mercuric chloride or zinc chloride or magnesium chloride, 20 percent by weight.

Also, the antistatic layer coatings can contain in an effective amount of, for example, from about 0.5 to about 10 percent by weight of colloidal silica particles, a carbonate, such as calcium carbonate, and the like primarily for the purpose of transparency traction during the feeding process.

Illustrative examples of supporting substrates with an effective thickness of, for example, from about 50 microns to about 150 microns, and preferably of a thickness of from about 75 microns to about 125 microns that may be selected for the transparencies of the present invention include Mylar, commercially available from E.I. DuPont; Melinex, commercially available from Imperial Chemical Inc.; Celenar, commercially available from Celanese, Inc.; polycarbonates, especially Lexan; polysulfones, cellulose triacetate; poly(vinyl chlorides), cellophane and poly(vinyl fluorides); and the like, with Mylar being particularly preferred in many embodiments because of its availability and lower costs.

Filler components in various effective amounts such as, for example, from about 0.5 to about 10 and preferably from about 1 to about 5 weight percent can be included in the coating as indicated herein. Examples of fillers include colloidal silicas preferably present, for example, in one embodiment in an amount of 1 weight percent (available as Syloid 74 from W.R. Grace Company); calcium carbonate, (Microwhite Sylacauga Calcium Products) titanium dioxide (Rutile NL Chem. Canada Inc.), and the like. While it is not desired to be limited by theory, it is believed that the primary purpose of the fillers is as a slip component for the transparency traction during the feeding process.

The aforementioned coatings can be present on the supporting substrates, for example each exposed surface thereof such as Mylar, in various thickness depending on the coatings selected and the other components utilized; however, generally the total thickness of the coatings is from about 2 to about 15 microns, and preferably from about 3 to about 10 microns. Moreover, these coatings can be applied by a number of known techniques including reverse roll, extrusion and dip coating processes. In dip coating, a web of material to be coated is transported below the surface of the coating material by a single roll in such a manner that the exposed site is saturated, followed by the removal of any excess by a blade, bar or squeeze rolls. With reverse roll coating, the premetered material is transferred from a steel applicator roll to the web material moving in the opposite direction on a backing roll. Metering is performed in the gap precision-ground stainless steel rolls. The metering roll is stationary or is coating slowly in the opposite direction of the applicator roll. Also, in slot extrusion coating there is selected a slot die to apply coating materials with the die lips in close proximity to the web of material to be coated. Once the desired amount of coating has been applied to the web, the coating is dried at 70° to 100° C. in an air dryer.

In one process embodiment, the xerographic transparencies of the present invention are prepared by providing a supporting substrate such as Mylar in a thickness of from about 75 to about 125 microns; and applying to each side of the substrate by known dip coating process, in a thickness of from about 3 to 15 microns, a coating composition comprised of an adhesive layer overcoated with an antistatic layer as illustrated herein. Thereafter, the substrate and coatings are air dried at 25° C. for 60 minutes in a fume hood equipped with adjustable volume exhaust system. The resulting transparency can be utilized in various imaging apparatuses including the xerographic imaging apparatus such as those available commercially as the Xerox Corporation 1005 TM and wherein there results images thereon, and the like.

The charge acceptance characteristics and charge decay of the transparencies and papers were measured with a static charge analyzer Model 276 available from Princeton Electro Dynamics. Sample discs of 1 inch diameter were prepared from the transparencies or papers and inserted into the two sample ports on the turntable using tweezers. On rotating the turntable and applying the corona charge to the coating for 5 seconds, holding the charge in the dark for between 5 to 10 seconds and exposing it to light for further 10 seconds, plots of voltage versus time were obtained. A comparative evaluation of these plots can provide informaiton about the effectiveness of the antistatic additives in the coatings. For example, uncoated polyester of a thickness of 100 microns (μm) tested on a static charge analyzer accepted a charge of about 1,200 volts which did not decay with light. A coating of 5 μm in thickness of poly(ethylene oxide) (POLY OXWSRN-3000 purchased from Union Carbide) and dissolved in a 90:10 mixture of methanol and water, respectively, (poly OX WSRN-3000 is not soluble in methanol alone) coated on a polyester sheet accepted a charge of about 950 volts, retained that charge in the dark and decayed slowly on exposure to light. With incorporation of varying amounts (0.1, 0.2, 0.5, 0.85, 1.35 and 2.0 percent by weight) of potassium iodide to the aforementioned coating solution of poly(ethylene oxide) and coating thereon of a polyester, transparencies were obtained which accepted charges of 570, 185, 150, 120, 100 and 80 volts, respectively, and that charge decayed instantly when exposed to light. These results indicate that incorporation of from about 0.1 to 2.0 percent by weight of potassium iodide (metal halide) to poly(ethylene oxide) (polymer containing oxyalkylene units) renders the transparencies charging and discharging characteristics similar to those of commercially available xerographic papers, which accept in general between 100 to about 200 volts (and in some instances up to 400 volts) and discharge instaneously when exposed to light.

In another similar embodiment, poly(ethylene oxide) was replaced with a block copolymer of ethylene oxide/propylene oxide (Tetronic 50R8, BASF Corporation) and coated on polyester from a 10 percent by weight solution in pure methanol. This coating accepted a charge of 1,260 volts which discharged very slowly on exposure to light and approached 400 volts, which residual charge stayed on the transparency. On incorporation of 0.1, 0.2, and 0.4 percent by weight of potassium iodide to the aforementioned coating solution of ethylene oxide/propylene oxide block copolymer and coating these on a polyester, tranparencies were obtained which accepted charges of 700, 410 and 210 volts, respectively. These results indicate that potassium iodide is equally effective in lowering charge acceptance levels of polymers other than poly(ethylene oxide) providing they contain oxyalkylene units.

In another embodiment, blends of vinyl pyrrolidone/vinyl acetate copolymer which when coated on polyester alone accepts a charge of 1,180 volts without discharging (#368, Scientific Polymer Products)

and poly(ethylene glycol monooleate) (Alkamuls 600-MO, Alkaril Chemicals) a poor antistat in proportions of 90:10, 80:20, 70:30 (in 5 percent concentration) in methanol were coated on polyester sheet and tested for their charging/discharging characteristics. These three transparencies charged to about 1,340 volts, but discharged to 1,300, 1,200, 1,080 volts as the concentration of poly(ethylene glycol monooleate) increased from 10 to 20 to 30 percent by weight in the blend. On incorporation of potassium iodide in concentrations of 2.5, 5.0 and 7.0 percent by weight to the aforementioned 90:10, 80:20 and 70:30 blends of vinyl pyrrolidone/vinyl acetate and poly(ethylene glycol mono oleate), and coating these on a polyester substrate, transparencies were provided which charged and discharged rapidly. For 90:10 blend which charged to 1,340 volts and discharged to 1,300 volts only, addition of 2.5, 5.0, 7.0 percent of potassium iodide brought the charging levels to 1,300, 990, 830 which discharged instaneously. For 80:20 blend and 70:30 blend, the levels of charging were 740, 500, 350 and 640, 400, 250, respectively. This embodiment indicates that oxyalkylene segment containing polymers, which do not possess acceptable antistatic properties, can be activated on the addition of potassium iodide, and wherein complexes thereof are formed.

In another embodiment, two blends of vinyl pyrrolidone/vinyl acetate copolymer were prepared with an alkanol amide (Alkamide 2104, Alkaril Chemicals) in proportions of 90:10 and 70:30, respectively, in methanol (5 percent by weight) and coated on the above polyester. These transparencies charged to 1,180 and 680 volts and discharged instantaneously. On incorporation of 2.5, 3.5, 4.5 and 7.0 percent potassium iodide to the above blends, and coating them on polyester, transparencies were provided with the charging levels lowered to 800, 630, 450, 340 in the 90:10 blend and to 160, 130, 100 and 80 volts in the 70:30 blend. These results indicate that 30 percent by weight of alkamide 2104 can be selected to charge vinyl pyrrolidone/vinyl acetate copolymer to a level of 680 volts whereas if 3.5 percent by weight of potassium iodide is added to the blend, one needs only 10 percent by weight of alkamide 2104 in this embodiment. These results further demonstrate that the presence of potassium iodide can enhance the performance of an oxyalkylene unit containing antistat.

In another embodiment, the performance of poly(ethylene oxide) (POLYOX WSRN-3000) coated film which was shown to accept a charge of 1,200 volts and discharge completely with light, was observed to be improved when a 92:8 by weight blend of poly(ethylene oxide) and urea coated on polyester yielded transparencies which charged to 400 volts only and discharged completely. These results indicate that the oxyalkylene containing polymers can also be made better antistats in the presence of urea containing compounds. These antistatic complexes of oxyalkylene containing polymers with potassium iodide and/or urea can be incorporated in resin binders or used alone for transparency applications as indicated herein.

The imaging technique in known ink jet printing involves, for example, the use of one or more ink jet assemblies connected to a pressurized source of ink, which is comprised of water, glycols, and a colorant such as magenta, cyan, yellow or black dyes. Each individual ink jet includes a very small orifice usually of a diameter of 0.0024 inch, which is energized by magneto restrictive piezoelectric means for the purpose of emitting a continuous stream of uniform droplets of ink at a rate of 33 to 75 kilohertz. This stream of droplets is desirably directed onto the surface of a moving web of, for example, the transparencies of the present invention, which stream is controlled to permit the formation of printed characters in response to video signals derived from an electronic character generator and in response to an electrostatic deflection system.

In the known formation and development of xerographic images, there is generally applied to a latent image generated on a photoconductive member a toner composition (dry or liquid) of resin particles and pigment particles. Thereafter, the image can be transferred to a suitable substrate such as natural cellulose, the transparencies of the present invention, or plastic paper and affixed thereto by, for example, heat, pressure or combination thereof.

In dot matrix printing, a printer such as Roland PR-1012 is connected to an IBM-PC computer loaded with a screen/printer software specially supplied for the printer. Any graphic images produced by the appropriate software on the screen can be printed by using the print screen key on the computer keyboard. The ink ribbons used in dot matrix printers are generally comprised of Mylar coated with blends of carbon black with reflex blue pigment dispersed in an oil, such as rape seed oil, and a surfactant, such as lecithin. Other correctable ribbons which are also used in typewriter printing can be selected and are usually comprised of Mylar coated with blends of soluble nylon, carbon black and mineral oil.

The optical density measurements recited herein, including the working examples, were obtained on a Pacific Spectrograph Color System. The system consists of two major components: an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component such as glass was included. A high resolution full dispersion, grating monochromator was used to scan the spectrum from 380 to 720 nanometers. The data terminal features a 12 inch CRT display, numerical keyboard for selection of operating parameters, and the entry of tristimulus values; and an alphanumeric keyboard for entry of product standard information.

In embodiments of the present invention, there is provided a transparent substrate material for receiving or containing an image comprised of a supporting substrate, an ink toner receiving coating composition present on each of surface of the substrate and comprised of an adhesive layer, and an antistatic layer contained on both surfaces of the adhesive layer, which antistatic layer is comprised of complexes of metal halides, or urea compounds both with polymers containing oxyalkylene units; a transparent substrate material for receiving or containing an image comprised of a supporting substrate, an ink toner receiving coating composition present on each of surface of the substrate and comprised of an adhesive layer, and an antistatic layer contained on both outer surfaces of the adhesive layer, which antistatic layer is comprised of complexes of metal halides or urea compounds both with polymers containing oxyalkylene units; a transparent substrate material for receiving an image comprised of a supporting substrate, an ink toner receiving coating composition on two surfaces of the substrate and comprised of an adhesive layer, and antistatic layers in contact with each surface of the adhesive, and comprised of complexes of metal halides or urea compounds with polymers containing oxyalkylene units; a transparent substrate material for receiving an image comprised of a supporting substrate, an ink toner receiving coating composition on two surfaces of the substrate and comprised of an adhesive layer, and an antistatic layer in contact with each surface of the adhesive layer, and comprised of complexes of metal halides with polymers containing oxyalkylene segments; a transparent substrate material for receiving an image comprised of a supporting substrate, an ink toner receiving coating composition on two surfaces of the substrate and comprised of an adhesive layer, and antistatic layers in contact with each surface of the adhesive, and comprised of urea compounds with polymers containing oxyalkylene segments; and a transparent substrate material for receiving an image comprised of a supporting substrate, an ink toner receiving coating composition on two surfaces of the substrate and comprised of an adhesive layer, and an antistatic layer in contact with each surface of the adhesive layer, and comprised of complexes of urea compounds with polymers containing oxyalkylene units in a polymer binder.

The following examples are being submitted to further define specific embodiments of the present invention, it being noted that these examples are intended to illustrate and not limit the scope of the present invention. Parts and percentages are by weight unless otherwise indicated.

EXAMPLE I

There were prepared 10 coated transparency Mylar sheets of a thickness of 100 microns by affecting a dip coating of these (Mylar) sheets, both (two) sides for each sheet, (10) into a coating solution containing a chlorinated (65 percent by weight) poly(isoprene), obtained from Scientific Polymer Products, which solution was present in a concentration of 1 percent by weight in toluene. Subsequent to air drying for 60 minutes at 25° C. in a fumehood equipped with an adjustable volume exhaust system and monitoring the weight prior to and subsequent to coating, the coated sheets had present on each side 100 milligrams, 1 micron in thickness, of the adhesive chlorinated poly(isoprene). These sheets (10) were then coated with an antistatic polymer layer by affecting a dip coating of these sheets into a solution comprised of a mixture of poly(ethylene oxide) (Poly OX WSRN-3000, Union Carbide), 99.5 percent by weight, and potassium iodide, 0.5 percent by weight, which solution was present in a concentration of 0.5 percent by weight in methanol. Subsequent to air drying for 60 minutes at 25° C. and monitoring the difference in weight prior to and subsequent to coating, the coated sheets had present on each exposed surface (two) of the adhesive layer, or both sides, 50 milligrams, 0.5 micron in thickness, of the antistatic layer. The prepared coated sheets were then fed individually into a Xerox Corporation 1075 TM imaging apparatus containing a carbon black toner composition, (styrene butadiene, 91/9, 90 weight percent, carbon black Regal 330®, 10 weight percent) and there were obtained images with an average optical density values of 1.60 (black). These images could not be hand wiped or lifted with a scotch tape 60 seconds subsequent to their preparation.

EXAMPLE II

There were prepared 20 coated transparency Mylar sheets of a thickness of 100 microns by affecting a dip coating of the Mylar sheets, both (two) sides for each sheet, (20) into a coating solution of chlorinated (65 percent by weight) poly(propylene), obtained from Scientific Polymer Products, which solution was present in a concentration of 1 percent by weight in toluene. Subsequent to air drying for 60 minutes at 25° C. in a fumehood equipped with an adjustable volume exhaust system and monitoring the weight prior to and subsequent to coating, the coated sheets had present on each side, 100 milligrams, 1 micron in thickness, of the adhesive chlorinated poly(propylene) polymer. These sheets (20) were then coated with an antisatic polymer layer by affecting a dip coating of these sheets into a solution comprised of a mixture of poly(2-hydroxyethyl methacrylate) (Scientific Polymer Products), 65 percent by weight, poly(ethylene oxide) (Poly OX WSRN-3000, Union Carbide), 32 percent by weight, and sodium iodide (Aldrich Chemicals), 2 percent by weight, colloidal silica, 1 percent by weight, which solution was present in a concentration of 3 percent by weight in methanol. Subsequent to air drying for 60 minutes at 25° C., and monitoring the difference in weight prior to and subsequent to coating, the coated sheets had present on each exposed side of the adhesive layer, 300 milligrams, 3 microns in thickness, of the antistatic layer. Ten of these sheets were fed into a Xerox Corporation 1025 TM imaging apparatus containing the carbon black toner composition of Example I. The average optical density of the 1025 TM images was 1.30. These images could not be handwiped or lifted with a scotch tape 60 seconds subsequent to their preparation.

The remaining 10 sheets were fed individually into a Xerox Corporation 4020 TM color ink jet printer having incorporated therein four separate developer inks, commerically available from Sharp Inc. and believed to be comprised of water, 92 percent by weight, ethylene glycol, 5 percent by weight, and a magenta, cyan, yellow and black colorant, respectively, 3 percent by weight, and there were obtained images with an average optical density values of 1.70 (black), 1.35 (magenta), 1.50 (cyan) and 0.85 (yellow).

EXAMPLE III

There were prepared 10 coated transparency Mylar sheets of a thickness of 75 microns by affecting a dip coating of these sheets, both sides (each exposed surface) for each sheet (10) into a coating mixture of poly(ethylene) chlorosulfonated (#107) obtained from Scientific Polymer Products, 80 percent by weight, and phosphate ester (alkaphos B6-56A Alkaril Chemicals), 20 percent by weight, which mixture was present in a concentration of 3 percent by weight in toluene. Subsequent to air drying for 60 minutes at 25° C. in a fumehood equipped with adjustable volume exhaust system and monitoring the difference in weight prior to and subsequent to coating these dried sheets had present on each side 300 milligrams, 3 microns in thickness of the adhesive layer polymer. These sheets were then coated with an antistatic polymer layer by affecting a dip coating thereof into a solution comprised of a mixture of vinyl alcohol/vinyl butyral copolymer (with a vinyl alcohol content of 19.5 percent by weight) (Scientific Polymer Products), 54 percent by weight, ethylene oxide/propylene oxide (Tetronic 908, BASF Corporation) copolymer, 38 percent by weight, and urea (Aldrich Chemical Company), 8 percent by weight, which mixture was present in a concentration of 2 percent by weight in methanol. Subsequent to air drying for 60 minutes at 25° C. in a fumehood equipped with adjustable volume exhaust system and monitoring the difference in weight prior to and subsequent to coating, these dried sheets had present on each side of the exposed adhesive layer, 200 milligrams, 1.5 microns in thickness, of the antistatic polymer layer in contact with the adhesive polymer layer. These sheets were then fed into a Roland PR-1012 Dot Matrix printer having incorporated therein a black cloth ribbon doped with an ink believed to be comprised of carbon black, lecithin, reflex blue pigment and rape seed oil, and there were obtained transparency sheets with images with an average optical density of 1.0.

EXAMPLE IV

There were prepared 10 coated transparency Mylar sheets of a thickness of 100 microns by affecting a dip coating of Mylar sheets, both (two) sides for each sheet, (10) into a coating solution containing a copolymer of ethylene/vinyl acetate (vinyl acetate content 50 percent by weight), obtained from Scientific Polymer Products, which solution was present in a concentration of 2 percent by weight in toluene. Subsequent to air drying for 60 minutes at 25° C. in a fumehood equipped with an adjustable volume exhaust system and monitoring the weight prior to and subsequent to coating, the coated sheets had present on each side 200 milligrams, 2.5 microns in thickness, of the adhesive ethylene/vinyl acetate copolymer. These sheets were then coated with an antistatic polymer layer by affecting a dip coating of these sheets into a solution comprised of a mixture of hydroxypropylmethyl cellulose (Methocel K35LV, Dow Chemicals), 54 percent by weight, ethylene oxide/propylene oxide block copolymer (Tetronic 50R2, BASF Corporation), 38 percent by weight, and urea (Aldrich Chemicals) 8 percent by weight, which solution was present in a concentration of 3 percent by weight in methanol. Subsequent to air drying for 60 minutes at 25° C. and monitoring the difference in weight prior to and subsequent to coating, the coated sheets had present on each exposed side of the adhesive layer 300 milligrams, 3 microns in thickness, of the antistatic polymer layer in contact with the adhesive ethylene/vinyl acetate copolymer layer. These sheets were then fed into a Xerox 4020 TM color ink jet printer, and there were obtained images with an average optical density values of 1.65 (black), 1.40 (magenta), 1.55 (cyan) and 0.80 (yellow).

EXAMPLE V

There were prepared 10 coated transparency Mylar sheets of a thickness of 100 microns by affecting a dip coating of these sheets, both (two) sides for each sheet, (10) into a coating solution containing a chlorinated, 65 percent by weight, poly(isoprene), obtained from Scientific Polymer Products, which solution was present in a concentration of 2 percent by weight in toluene. Subsequent to air drying for 60 minutes at 25° C. in a fumehood equipped with an adjustable volume exhaust system and monitoring the weight prior to and subsequent to coating, the coated sheets had present on each side 200 milligrams, 2 microns in thickness, of the adhesive chlorinated poly(isoprene). These sheets (10) were then coated with an antistatic polymer layer by affecting a dip coating of these sheets into a solution comprised of a mixture of vinyl alcohol/vinyl acetate copolymer (with a vinyl alcohol content of 18 percent by weight), 60 percent by weight, ethylene oxide/propylene oxide block copolymer (Tetronic 50R8, BASF Corporation), 38 percent by weight, potassium iodide (Aldrich Chemicals), 2 percent by weight, which solution was present in a concentration of 1 percent by weight in methanol. Subsequent to air drying for 60 minutes at 25° C., and monitoring the difference in weight prior to and subsequent to coating, the coated sheets had present on each side, 100 milligrams, 1 micron in thickness, of the antistatic polymer layer in contact with the adhesive chlorinated poly(isoprene) layer. These sheets were then fed into a Xerox Corporation 1005 TM color imaging apparatus and images were obtained on the aforementioned transparencies with an average optical density (that is the sum of the optical densities of 10 sheets divided by 10) of 1.80 (black), 0.90 (yellow), 1.50 (cyan) and 1.65 (magenta). These images could not be handwiped or lifted with scotch tape (Minnesota Minning and Manufacturing) 60 seconds subsequent to their preparation.

EXAMPLE VI

There were prepared 10 coated transparency Mylar sheets of a thickness of 125 microns by affecting a dip coating of these (Mylar) sheets, both sides for each sheet into a coating mixture of poly(styrene) (molecular weight 400,000, Scientific Polymer Products), 90 percent by weight, and a 1:1 alkanol amide (coconut-diethanol amide Alkamide CDE, Alkaril Chemicals), 10 percent by weight, which mixture was present in a concentration of 2 percent by weight in toluene. Subsequent to air drying for 60 minutes at 25° C. in a fumehood equipped with adjustable volume exhaust system and monitoring the difference in weight prior to and subsequent to coating, these dried sheets had present on each side 300 milligrams, 3 microns in thickness, of the adhesive layer polymer. These sheets were then coated with an antistatic polymer layer by affecting a dip coating of these sheets into a solution comprised of a mixture of cellulose acetate hydrogen phthalate (CAP, Eastman Kodak), 60 percent by weight, ethylene oxide/propylene oxide block copolymer (Tetronic 50R8, BASF Corporation), 38 percent by weight, potassium iodide, 2 percent by weight which mixture was present in a concentration of 1 percent by weight in acetone and methanol blend (2.8 grams of Tetronic 50R8 and 0.2 gram of potassium iodide dissolved in 300 milliliters of methanol were blended with a solution of cellulose acetate hydrogen phthalate (7.0 grams in 700 milliliters of acetone). Subsequent to air drying for 60 minutes at 25° C., and monitoring the difference in weight prior to and subsequent to coating, the coated sheets had present on each side (both sides that are exposed) of the adhesive layer, 100 milligrams, 1 micron in thickness, of the antistatic layer. These sheets were then fed individually into a Xerox Corporation 1025 TM imaging apparatus containing a carbon black toner composition. The average optical density of these images was 1.25. These images could not be hand wiped or lifted with a scotch tape 60 seconds subsequent to their preparation.

Other modifications of the present invention will occur to those skilled in the art, subsequent to a review of the present application. These modifications, including equivalents thereof are intended to be included within the scope of the present invention.

What is claimed is:

1. A transparent substrate material for receiving or containing an image consisting essentially of a supporting substrate, an ink toner receiving coating composition on both sides of the substrate and comprised of an adhesive layer and an antistatic layer contained on two surfaces of the adhesive layer, which antistatic layer is comprised of metal halides selected from the group consisting of potassium iodide, sodium iodide, lithium bromide, zinc chloride, mercuric chloride, magnesium chloride, and cadmium chloride with polymers containing oxyalkylene segments, or urea compounds with polymers containing oxyalkylene segments.

2. A material in accordance with claim 1 wherein the antistatic layer is formed from a mixture of the antistatic component with a resin binder polymer.

3. A material in accordance with claim 2 wherein the antistatic layer contains filler components.

4. A material in accordance with claim 3 wherein the filler components are comprised of colloidal silica, calcium carbonate, titanium dioxide or mixtures thereof.

5. A material in accordance with claim 3, wherein the fillers are present in an amount of 0.5 to about 25 percent by weight of the antistatic layer.

6. A transparency in accordance with claim 3 wherein the binder polymer is cellulose acetate hydrogen phthalate, hydroxypropyl methyl cellulose phthalate, chlorinated rubber, styrene butadiene, vinyl alcohol/vinyl acetate, cellulose acetate, or ethyl cellulose.

7. A material in accordance with claim 2 wherein the binder polymers of the antistatic layer are comprised of cellulose acetate hydrogen phthalate, hydroxypropyl methyl cellulose phthalate, hydroxypropylmethyl cellulose acetate succinate, poly(diallyl phthalate), cellulose acetate butyrate, cel'ulose propionate, vinyl alcohol/vinyl acetate copolymer, vinyl alcohol/vinyl butyral copolymer, vinyl pyrrolidone/vinyl acetate copolymer, poly(n-butyl methacrylate), poly(isobutyl methacrylate), n-butyl methacrylate/isobutyl methacrylate copolymer, poly(2-hydroxyethyl methacrylate), poly(2-hydroxy propyl methacrylate), styrene/maleic anhydride copolymer, poly(4-vinyl pyridine), poly(vinyl butyral), ethyl cellulose, hydroxypropyl cellulose, hydroxy propyl methyl cellulose or hydroxy butyl methyl cellulose.

8. A material in accordance with claim 7 wherein the vinyl alcohol content in the vinyl alcohol/vinyl acetate and vinyl alcohol/vinyl butyral copolymers is from about 5 to about 35 percent by weight.

9. A material in accordance with claim 7 wherein the vinyl acetate content in the vinyl acetate/vinyl pyrrolidone copolymer, the n-butyl methacrylate content in the n-butyl methacrylate/isobutyl methacrylate copolymer, and the styrene content in the styrene/maleic anhydride copolymer is from about 25 to about 75 percent by weight.

10. A material in accordance with claim 2 wherein the antistatic layer is comprised of from about 1 to about 20 percent of the antistatic component and from about 99 to about 80 percent by weight of the binder polymer.

11. A material in accordance with claim 1 wherein the antistatic layer contains filler components.

12. A material in accordance with claim 11 wherein the filler components are comprised of colloidal silica, calcium carbonate, titanium dioxide or mixtures thereof.

13. A material in accordance with claim 11 wherein the fillers are present in an amount of from about 0.5 to about 10 percent by weight of the antistatic layer.

14. A material in accordance with claim 1 wherein the urea compounds are comprised of urea, thiourea, urea monohydrochloride, urea phosphate, or urea sulfate.

15. A material in accordance with claim 1 wherein the oxyalkylene segment containing polymers of the antistatic layer are comprised of poly(methylene oxide), poly(ethylene oxide), poly(propylene oxide), poly(tetramethylene oxide), poly(epichlorohydrin), poly(ethylene succinate), poly(ethylene adipate), ethylene oxide/propylene oxide block copolymers, alkanol amides, polyethylene glycol fatty acid esters, sorbitan ester ethoxylates, ethoxylated amines, fatty imidazolines, castor oil ethoxylates, alkanol amide ethoxylates, fatty acid ethoxylates, alcohol ethoxylates, alcohol alkoxylates, nonyl phenol ethoxylates, octylphenol ethoxylates, silicone poly alkoxylate block copolymers, quaternary ammonium copolymers of poly(ethylene oxide), poly(propylene glycol dimethacrylate), poly(ethylene glycol diacrylate), poly(ethylene glycol monomethyl ether), poly(ethylene glycol dimethyl ether), poly(ethylene glycol diglycidyl ether), ethylene oxide/2-hydroxyethyl/methacrylate/ethylene oxide block copolymers, ethylene oxide/hydroxy propyl methacrylate/ethylene oxide block copolymers, ethylene oxide/4-vinyl pyridine/ethylene oxide block copolymers, ionene/ethylene oxide/ionene or ethylene oxide/isoprene/ethylene oxide triblock copolymers.

16. A material in accordance with claim 15 wherein the content of ethylene oxide in the ethylene oxide/2-hydroxyethyl methacrylate/ethylene oxide, ethylene oxide/hydroxy propyl methacrylate/ethylene oxide, ethylene oxide/4-vinyl pyridine/ethylene oxide ethylene oxide/isoprene/ethylene oxide and ionene/ethylene oxide/ionene triblock copolymers is from about 20 to about 70 percent by weight.

17. A material in accordance with claim 1 wherein the adhesive layer components are comprised of poly(alkenes), halogenated poly(alkenes), halogenated poly(dienes), styrene/isoprene copolymers, ethylene/vinyl acetate copolymers, styrene/isobutylene copolymers, ethylene/ethyl acrylate copolymers, styrene/ethylene butylene copolymers, styrene/ethylene oxide copolymers, caprolactone/ethylene oxide copolymers, ethylene sulfide/ethylene oxide copolymer, or ethylene terephthalate/ethylene oxide copolymers.

18. A material in accordance with claim 17 wherein the poly(alkenes) are comprised of poly(ethylene), poly(propylene), poly(1-butene), halogenated poly(alkenes) comprised of chlorinated poly(ethylene), chlorinated poly(propylene), or chloro sulfonated poly(ethylene) with a sulfur content of from about 0.5 to about 1.65 percent by weight.

19. A material in accordance with claim 17 wherein the styrene content of styrene/ethylene butylene, styrene/isoprene, styrene/isobutylene, styrene/ethylene oxide copolymers is from about 10 to about 90 percent by weight.

20. A material in accordance with claim 17 wherein the ethylene oxide content of caprolactone/ethylene oxide, ethylene sulfide/ethylene oxide copolymer and ethylene terephthalate/ethylene oxide copolymers is from about 25 to about 75 percent by weight.

21. A material in accordance with claim 17 wherein the ethylene content of ethylene/vinyl acetate and ethylene/ethyl acrylate copolymers is from about 25 to about 90 percent by weight.

22. A material in accordance with claim 1 wherein the adhesive layer is comprised of mixtures of (a) ethyl cellulose, ethyl hydroxyethyl cellulose, poly(styrene), substituted poly(styrenes), poly(2-vinyl pyridine), chlorinated poly(isoprene), styrene/butadiene, acrylonitrile/butadiene, styrene/allyl alcohol, styrene/butyl methacrylate, methylmethacrylate/butadiene/styrene, acrylonitrile/butadiene/styrene; and (b) an antistatic plasticizer selected from the group consisting of alkanol amides, amine ethoxylates, imidazolines, quaternized imidazolines, sodium dialkyl sulfosuccinate, phosphate esters, or alkanolamide ethoxylates.

23. A material in accordance with claim 22 wherein the substituted poly(styrenes) are comprised of poly(α-methyl styrene), poly(p-methyl styrene), poly(p-isopropyl styrene), poly(p-tert-butylstyrene) poly(p-isopropyl α-methylstyrene), poly(p-chloro styrene), poly(p-bromo styrene), or poly(p-methoxy styrene).

24. A material in accordance with claim 22 wherein the styrene content in the styrene/butadiene, styrene-/allyl alcohol, styrene/butyl methacrylate copolymers is from about 50 to about 95 percent by weight.

25. A material in accordance with claim 22 wherein the butadiene content in the acrylonitrile/butadiene copolymer is from about 10 to about 50 percent by weight, and acrylonitrile content is from 90 to about 50 percent by weight.

26. A material in accordance with claim 22 wherein the styrene content in methyl methacrylate styrene/-butadiene and acrylonitrile/butadiene/styrene copolymers is from about 10 to about 80 percent by weight, the butadiene content is from about 60 to about 15 percent by weight, and the methyl methacrylate and acrylonitrile content is about 30 to about 5 percent by weight.

27. A material in accordance with claim 22 wherein the adhesive layer contains from about 50 to about 99 percent of the adhesive polymer and from about 50 to about 1 percent by weight of low molecular weight plasticizer.

28. A material in accordance with claim 1 wherein the ratio of said metal halides and the oxyalkylene segment containing polymers in the antistatic layer is from about 0.001 to about 1.0; and the ratio of urea compounds and the oxyalkylene segment containing polymers in the antistatic layer is from about 0.002 to about 4.0.

29. A material in accordance with claim 1 wherein the supporting substrate is selected from the group consisting of cellulose acetate, poly(sulfone), poly(propylene), poly(vinyl chloride), poly(vinyl fluoride), poly(styrene), cellophane and poly(ethylene terephthalate).

30. A material in accordance with claim 1 wherein the substrate is of a thickness of about 75 to 125 microns, the adhesive layer is of a thickness of from about 1 to about 10 microns and the antistatic layer is of a thickness of from about 1 to about 5 microns.

31. An image receiving member for an electrographic or electrophotographic imaging process, which member is comprised of the material of claim 1.

32. An image receiving member for an ink jet printing process, which member is comprised of the material of claim 1.

33. An image receiving member for a dot matrix printing process, which member is comprised of the material of claim 1.

34. A material in accordance with claim 1 wherein the adhesive layer has a melting point of from about 50° to about 100° C.

35. A transparency in accordance with claim 1 wherein the antistatic layer is comprised of polymers of ethylene oxide/propylene oxide.

36. A transparent substrate material for receiving or containing an image comprised of a supporting substrate, an ink toner receiving coating composition present on the substrate and comprised of an adhesive layer, and an antistatic layer contained on the exposed surfaces of the adhesive layer, which antistatic layer is comprised of metal halides selected from the group consisting of potassium iodide, sodium iodide, lithium bromide, zinc chloride, mercuric chloride, magnesium chloride, cadmium chloride, and mixtures thereof, or urea compounds with polymers containing oxyalkylene units.

37. A transparent substrate material for receiving or containing an image consisting essentially of a supporting substrate, an ink toner receiving coating composition present on each of surface of the substrate and comprised of an adhesive layer, and an antistatic layer contained on both outer surfaces of the adhesive layer, which antistatic layer is comprised of mixtures of metal halides selected from the group consisting of potassium iodide, sodium iodide, lithium bromide, zinc chloride, mercuric chloride, magnesium chloride, and cadmium chloride, or urea compounds with polymers containing oxyalkylene units.

38. A transparent substrate material for receiving an image consisting essentially of a supporting substrate, an ink toner receiving coating composition on two surfaces of the substrate and comprised of an adhesive layer, and antistatic layers in contact with each surface of the adhesive layer, and comprised of a mixture of metal halides selected from the group consisting of potassium iodide, sodium iodide, lithium bromide, zinc chloride, mercuric chloride, magnesium chloride, and cadmium chloride, each of said metal halides containing polymers with oxyalkylene units.

39. A transparency in accordance with claim 38 wherein the transparent substrate contains an image thereon.

40. A transparent substrate material for receiving an image comprised of a supporting substrate, an ink toner receiving coating composition on two surfaces of the substrate and comprised of an adhesive layer, and an antistatic layer in contact with each surface of the adhesive layer, and comprised of a mixture of a metal halide selected from the group consisting of potassium iodide, sodium iodide, lithium bromide, zinc chloride, mercuric chloride, magnesium chloride, and cadmium chloride with a polymer containing oxyalkylene units.

41. A transparency in accordance with claim 40 wherein the transparent substrate contains an image thereon.

42. A transparent substrate material for receiving an image consisting essentially of supporting substrate, an ink toner receiving coating composition on two surfaces of the substrate and comprised of an adhesive layer, and antistatic layers in contact with each surface of the adhesive layer, and comprised of a mixture of urea compounds with polymers containing oxyalkylene segments.

43. A transparency in accordance with claim 42 wherein the transparent substrate contains an image thereon.

* * * * *